US005555575A

United States Patent [19]

Anscombe-Black et al.

[11] Patent Number: 5,555,575

[45] Date of Patent: Sep. 17, 1996

[54] LIFT ASSEMBLY

[75] Inventors: William A. B. Anscombe-Black, Maroochydore; Allan J. Farthing, Mooloolaba, both of Australia

[73] Assignee: Aqua Medics Pty. Ltd., Maroochydore, Australia

[21] Appl. No.: 244,012

[22] PCT Filed: Nov. 9, 1992

[86] PCT No.: PCT/AU92/00603

§ 371 Date: Aug. 29, 1994

§ 102(e) Date: Aug. 29, 1994

[87] PCT Pub. No.: WO93/08783

PCT Pub. Date: May 13, 1993

[30] Foreign Application Priority Data

Nov. 8, 1991 [AU] Australia ..... PK9353

[51] Int. Cl.[6] ..... A47K 3/02

[52] U.S. Cl. ..... 4/563.1

[58] Field of Search ..... 4/561.1–566.1

[56] References Cited

U.S. PATENT DOCUMENTS 2,779,949 2/1957 Crispen ..... 4/563.1

3,078,473 2/1963 Daniels ..... 4/563.1

3,280,409 10/1966 Cotner ..... 4/563.1

3,381,317 5/1968 Daniels et al. ..... 4/563.1

3,714,672 2/1973 Condon ..... 4/563.1

FOREIGN PATENT DOCUMENTS 9111133 8/1991 WIPO ..... 4/566.1

*Primary Examiner*—Charles E. Phillips

*Attorney, Agent, or Firm*—Amster, Rothstein & Ebenstein

[57] ABSTRACT

A lift assembly is provided for lifting a person between an elevated loading position at seat height and a lowered position such as within a bath tub. The lift assembly includes a mounting assembly which may be in the form of a seat slidable along a guide extending above the elevated loading position. The seat may be reciprocated along the guide by a water actuated ram connected to the water supply for the bath tub. Connecting struts connecting the seat slidably to the guide extend downwardly so as to support the seat below the mounting assembly when in the lowered position.

5 Claims, 4 Drawing Sheets

LIFT ASSEMBLY

This invention relates to a lift assembly capable of lifting a person, article or animal between raised and lowered positions.

This invention has particular but not exclusive application to a lift assembly adapted to assist persons into or out of a bath tub, and for illustrative purposes reference will be made to such application. However, it is to be understood that this invention could be used in other applications, including assisting persons to and from locations which are difficult to access. Furthermore while the specification hereinafter refers to a lift assembly for lifting persons it must be understood that a reference to a person may also embrace a reference to an article, an animal or the like.

Incapacitated and invalid bathers, such as the aged, infirmed and paraplegics often experience difficulties getting into or out of a bath tub. Accordingly, persons including nurses are frequently required to physically lift or otherwise assist them into or out of bath tubs, often risking injury to themselves. Futhermore, many bathers have slipped or fallen over, and as a consequence injured themselves, when either entering or leaving a bath tub due to their shape and wet, slippery surfaces.

Attempts have been made in the past to provide lifting means for lifting a patient to and from bath tubs however to date such attempts have been relatively impractical, requiring adoption of a special bath tub, external or internal fixing of the necessary supporting structure. Furthermore effective cleansing of the bath and/or lifting means was difficult and the usefulness of the bath was diminished.

The present invention aims to alleviate at least one of the above disadvantages and to provide a lift assembly which will be reliable and efficient in use.

With the foregoing in view, this invention in one aspect resides broadly in a lift assembly operable to lift a person between an elevated loading position and a lowered position and including:

- a mounting assembly including guide means extending above the elevated loading position
- a support assembly guided by said guide means for reciprocal movement between the elevated loading position and the lowered position, said support assembly including platform means and connecting means operatively connecting said platform means to said guide means, said connecting means being formed so as to extend downwardly to said platform means from said guide means and to support said platform means below said mounting assembly when in said lowered position, and
- lifting means co-operable with said guide means for raising and lowering said support assembly.

Preferably the lift assembly is adapted to lift a person to and from a bath tub but it may be used to lift a person to and from a reservoir such as a spa bath, swimming pool, or the like or through a access opening such as a man hole.

The support assembly may be capable of selective lateral movement relative to a bath tub. For example, the platform means may be capable of pivotal movement relative to a bath tub. Alternatively, the support assembly may be provided with a turn-table to facilitate entry or exit therefrom. The platform means may be in the form of an elongated rest for a patient in a prone position but preferably the platform means includes a seat upon which a person may be seated. The platform means may further include a back rest and arm and leg rests.

The guide means may include a side wall or walls of the reservoir. Preferably however, the guide means includes a guide rail or guide track along which the support assembly may slide or roll. The guide rail or guide track may be inclined to the vertical but preferably the guide rail or guide track extends substantially vertically so as to maximise the useable space within the bath tub. The connecting means may be hingedly connected to the guide means whereby the platform means may be folded upwardly away from the bath tub so as not to intrude into the bath tub when not required.

The lifting means may be in the form of a hoist or mechanical linkage but preferably it is fluid actuated and adapted to be operated by the fluid supply for the bath tub.

The lifting means may be an inflatable bladder which may provide support for the support means and may be inflated by water intended to be allowed to drain into the bath tub. Preferably however, the lifting means includes a fluid ram assembly including a cylinder mounted for reciprocal movement relative to a fixed piston. Suitably fluid is introduced into the cylinder through a tubular stem supporting the piston but if desired an external supply line could be provided.

The mounting assembly may include a mounting bracket or a plurality of mounting brackets which may be secured to a structure adjacent the bath tub such as a wall. Alternatively the mounting assembly may includes a mounting frame which may be attached to or supported on the upper perimeter flange or rim of the bath tub and/or an adjacent structure. Preferably, the mounting assembly includes a mounting frame having a U-shaped mounting base adapted to rest upon the rim of the bath tub at one end thereof.

The mounting frame may include a plurality of frame members and selected frame members may be tubular members adapted to convey fluids to and from a fluid actuated lifting means. Preferably the mounting base includes opposed arm members extending from opposite ends of a transverse frame member which supports the guide means and the piston strut. The lifting means may include control means for controlling the flow of fluids to and from the fluid actuated lifting means. The control means may include a valve or a plurality of valves which operatively control the flow of fluid to and from the lifting means and which permit the discharge of fluid into the bath tub. Suitably the control means is operable by a person seated on the platform means and may include drainage means for draining fluid from the fluid actuated lifting means. Preferably the drainage means is operable such that there are substantially no actuating fluids retained. The drainage means may be actuated automatically upon movement of the support means to its lower position. The drainage means may include an outlet valve located in the fluid supply line and, when used in a bath installation, be adapted to drain fluid into the bath.

In another aspect resides broadly in a lift assembly operable to lift a person between an elevated loading position and a lowered position and including:

- a mounting assembly including guide means;
- a support assembly for supporting a person and guided by said guide means for reciprocal movement between the elevated loading position and the lowered position;
- fluid operable lifting means co-operable with said guide means for raising and lowering said support assembly, said fluid operable lifting means including a fluid cylinder and a piston slidable within said fluid cylinder, one of the cylinder or piston being secured relative to the mounting means and the other to the support assembly.

Preferably the piston is supported in an elevated position by a tubular stem adapted to communicate through the piston with the cylinder whereby fluid may flow to and from the cylinder via the tubular stem. Suitably the tubular stem extends substantially vertically and intermediate spaced guide bars disposed parallel thereto and along which the support assembly may slide. It is also preferred that the tubular stem, the guide bars and the mounting assembly form a rigid frame which may rest upon the elevated rim of a bath tub to operatively support a person on said support assembly in the bath tub.

In yet a further aspect this invention resides in a lift assembly operable to lift a person between an elevated loading position and a lowered position and including:

a mounting assembly including guide means;

a support assembly for supporting a person and guided by said guide means for reciprocal movement between the elevated loading position and the lowered position;

lifting means co-operable with said guide means for raising and lowering said support assembly, and wherein the mounting assembly is a rigid frame which may rest upon the elevated rim of a bath tub to operatively support a person on said support assembly in the bath tub.

Preferably the lifting means includes a fluid cylinder and a piston slidable within said fluid cylinder, one of the cylinder or° piston being secured relative to the mounting means and the other to the support assembly. Preferably the piston includes a tubular stem and wherein the tubular stem, the guide bars and the mounting assembly form a rigid frame which may rest upon the elevated rim of a bath tub to operatively support a person on said support assembly in the bath tub.

In order that this invention may be more readily understood and put into practical effect, reference will now be made to the accompanying drawings which illustrate a preferred embodiment of the invention and wherein.

Figure 2:
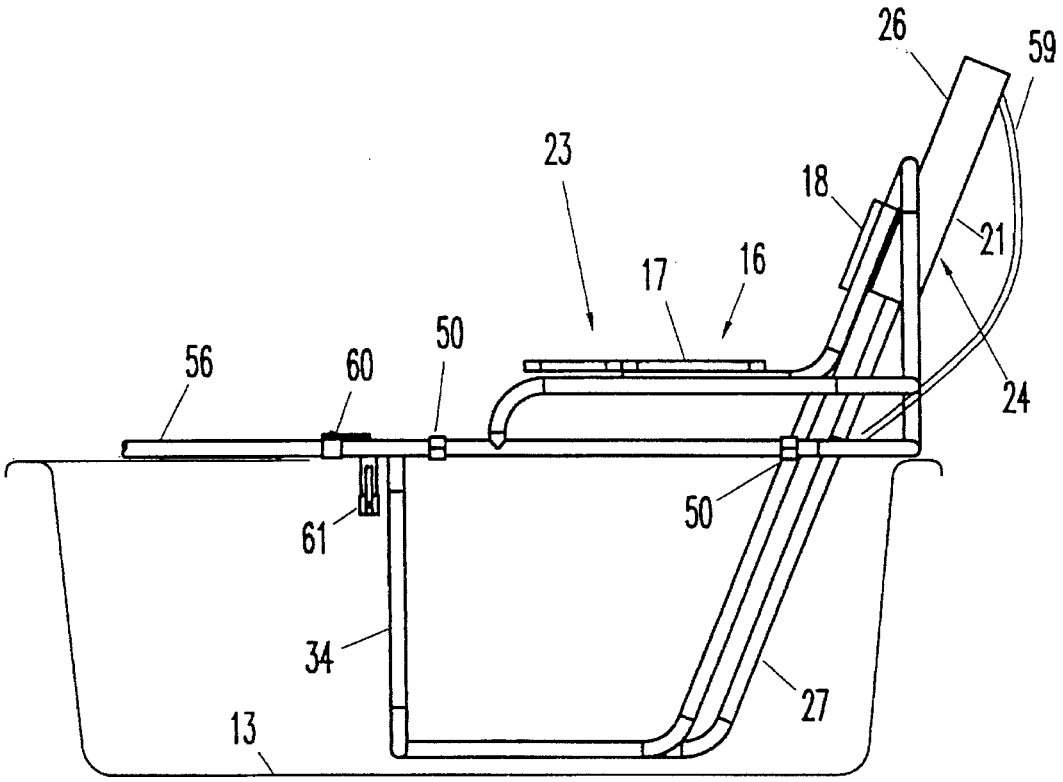
FIG. 2 is a side view of the lift assembly illustrated in FIG. 1.

FIGS. 1 to 4 illustrate a lift assembly 10 positioned in a bath 12 comprising a bottom wall 13, side walls 14 and an upper rim 15

The lift assembly 10 includes a support assembly 16 for supporting a person seated thereon comprising a substantially horizontal seat 17 and a back rest 18. The seat 17 and back rest 18 are interconnected by a pair of seat support members 19 and 20 which extend underneath the seat 17 and behind the back rest 18.

The support assembly 16 is operatively connected to lifting means 21 and may move between a lower position 22, wherein the seat 17 is located adjacent the bottom wall 13 of the bath 12, and an upper position 23, wherein the seat 17 is spaced above the rim 15 of the bath 12.

The lifting means 21 includes a fluid driven ram 24 comprising a piston slidably located within a cylinder 26 and wherein the cylinder 26 is rigidly connected to the back rest 18.

The piston includes a stem 27 and a disc shaped head portion, not shown, and wherein the head portion is provided with an upwardly and outwardly directed peripheral lip which is adapted to sealably engage or abut the internal wall of the cylinder 26.

The support assembly 16 and the lifting means 21 are interconnected by a supporting frame 31 which, in the case of the embodiment illustrated in FIGS. 1 to 4, is supported by the bottom wall 13 and the rim 15 of the bath tub 12. The supporting frame 31 includes a lower frame assembly 32 cradled within the bath tub 12 and an upper frame assembly 33 supported by the rim 15 above the bath tub 12.

The lower frame assembly 32 includes a pair of front leg members 34 and 35 and a pair of rear transversely spaced leg members 36 and 37. The lower ends of the front leg members 4 and 35 are interconnected by a transverse frame member 38 and similarly, the rear leg members 34 and 35 are interconnected by a transverse frame member 39.

The base of the stem 27 of the piston is attached to transverse frame member 39 and extends upwardly therefrom and substantially parallel rear leg members 34 and 35.

The upper frame assembly 33 includes a pair of arm members 40 and 41 shown resting upon the rim 15 of the bath tub 12 and an intermediate frame member 42 which spans the bath tub. The upper frame assembly 33 further includes an inverted U shaped frame member 43 to which the upper ends of rear leg members 36 and 37 are attached.

The upper ends of rear leg members 36 and 37 provide guide means for guiding the movement of the support means 16 and wherein the support means 16 is slidably attached thereto by collars, not shown.

The upper frame assembly 33 is also provided with a plurality of pads 50 which may be inserted between the arm members 40 and 41 and the rim 15 of the bath tub 12 so as to minimiss scratching of the rim 15 and to minimiss unwanted movement of the lift assembly 10 relative to the bath tub 12.

The upper frame assembly 33 also includes hand rails 51 shown attached to arm members 40 and 41 and which may be of assistance to persons when either entering or leaving the bath tub 12.

The cylinder 26 is formed with a water inlet (not shown) through which water may flow both into and from the cylinder 26 thereby raising or lowering the support means 16.

The water flow into the cylinder 26 is regulated by a water inlet valve 60 and a water outlet valve 61. These valves 60 and 61 are connected to the tubular arm member 40 and wherein water may flow through the arm member 40 which is fluidly connected to the inlet formed in the cylinder 26 by a length of flexible tubing 59. The inlet valve 40 is fluidly connected to a water supply such as the hot or cold water tap 52 or 53 positioned above the bath by a length of tubing 56, or in an alternative embodiment, to a single outlet pipe connected to a source of hot and cold water, not shown.

Figure 5:
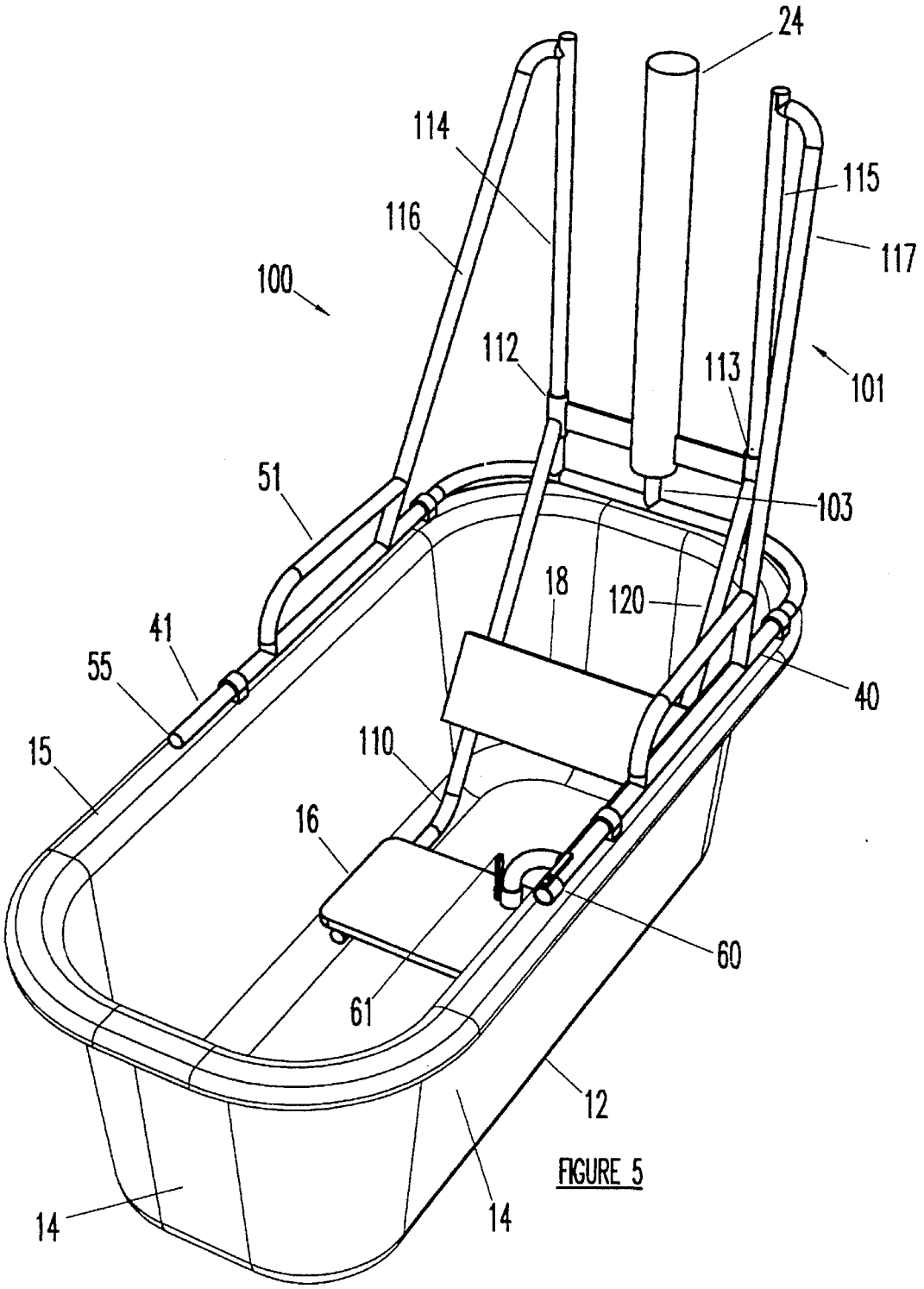
FIG. 5 is a perspective view of an alternative lift assembly constructed in accordance with the present invention.
Figure 6:
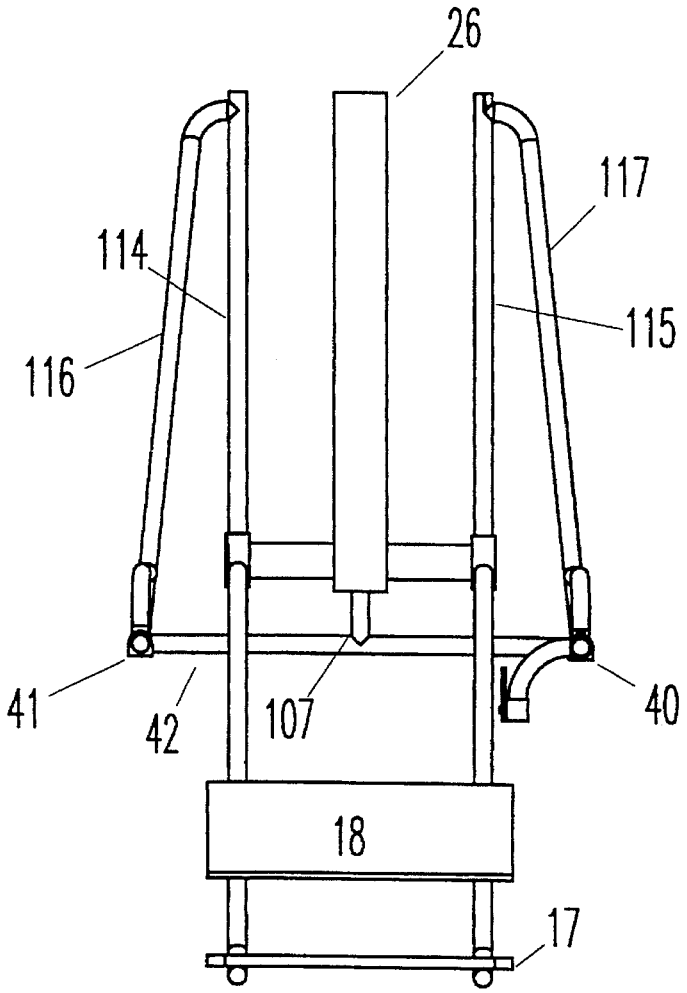
FIG. 6 is an end view of the lift assembly illustrated in FIG. 5.
Figure 7:
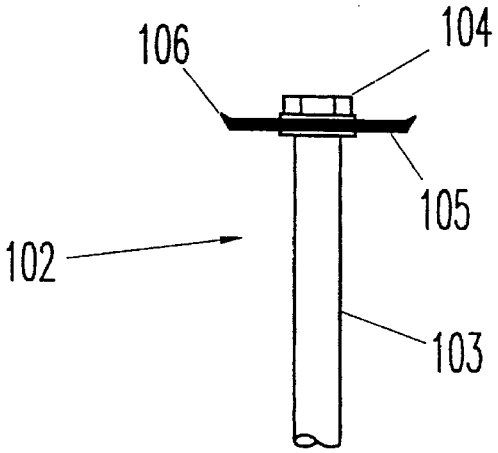
FIG. 7 is a side elevation of a piston for use with the lift assemblies illustrated in FIG. 1 to 6.

Referring to FIGS. 5, 6 and 7 there is shown a second lift assembly 100 and like numbers have been used to denote like parts. The lift assembly 100 is similar to the lift assembly 10 with the exception of the omission of the lower frame assembly 32 and the positioning of the lifting means 101 above the rim 15 of the bath tub 12.

The lifting means 101 includes a fluid driven ram 24 comprising a piston 102 slidably located within a cylinder 26 and wherein the cylinder 26 is rigidly connected to the back rest 18.

The piston 102 includes a tubular stem 103 having an upper open end 104 which extends above the upper surface of a disc shaped head portion 105 and wherein the head portion 105 is provided with an upwardly and outwardly directed peripheral lip 106 which is adapted to sealably engage or abut the internal cylindrical wall of the cylinder 26. The base 107 of the stem 103 is fluidly connected to frame member 42, which is tubular and which is fluidly connected to arm member 40.

Arm member 41 may also be tubular and may be adapted to convey water therethrough and wherein a user may elect to close the threaded free end 55 of arm member 41, as shown, or alternatively may attach a hand held shower rose thereto.

It will also be noted that seat 17 and back rest 18 are supported by a pair of support members 110 and 111 and wherein the upper ends of support members 110 and 111 are attached to respective collars 112 and 113 slidably mounted on respective upstanding frame members 114 and 115 which, in use, help guide the moving support means 16.

The frame members 114 and 115 are supported by respective inclined bracing members 116 and 117 and wherein the upper ends thereof are releasably secured to frame members 114 and 115 and may be detached therefrom in order to allow for the removal of the support means 16 and the cylinder 26 for maintenance purposes.

In use, the lift assembly 10 or 100 is placed into or on a bath tub and wherein the tubing 56, connected to the inlet valve 40, is connected to a source of water, ie. a bath tap 117.

A user may then open the bath tap 117 and the inlet valve 40 thereby allowing water to flow into the cylinder 26, causing the support means 16 to rise to its uppermost position 23 as indicated in FIG. 2.

With reference to the embodiment illustrated in FIG. 1 to 4, cylinder 26 may include a pad, slide or stop 58 which may abut against a wall at the rear of the bath tub 12.

At this stage, the water inlet valve 40 may be closed or water outlet valve 41 closed so as to divert the flow of water into the bath tub 12.

Figure 1:
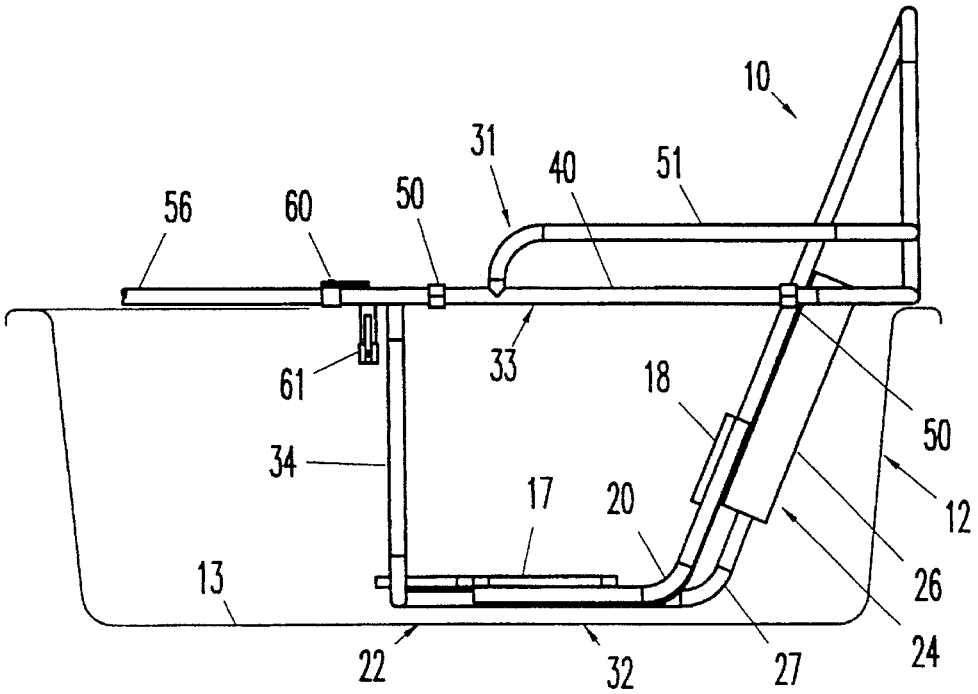
FIG. 1 is a side view of a lift assembly constructed in accordance with the present invention.
Figure 3:
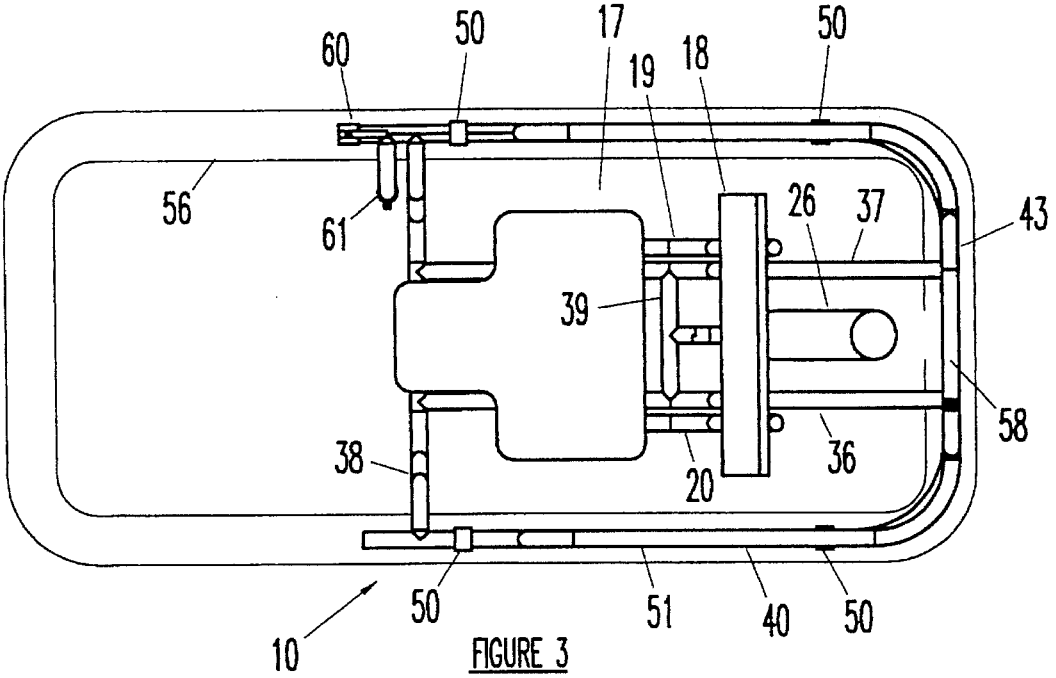
FIG. 3 is a plan view of the lift assembly illustrated in FIG. 1.
Figure 4:
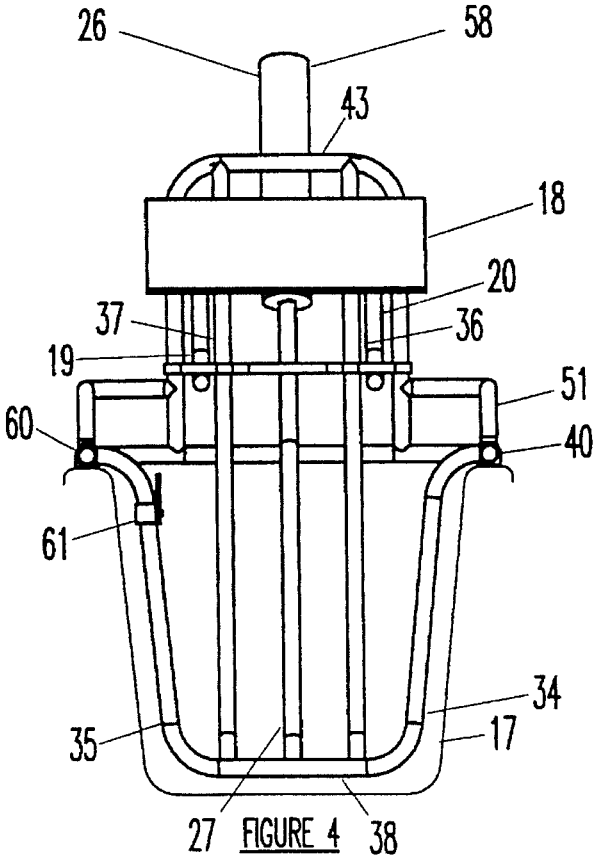
FIG. 4 is an end view of the lift assembly illustrated in FIG. 1.

A bather may then sit on the raised seat 17 and thereafter lower him or herself and the seat 17 into the water filled bath tub 12 by closing the water inlet valve 40 and by opening the water outlet valve 41 thereby allowing the water contained in the cylinder 26 to drain therefrom, see FIG. 1. By selective or controlled use of the outlet valve 41, the bather may control the rate at which he or she is lowered into the bath tub 12.

On completion of the bath, the bather may open the inlet valve 40 and close the outlet valve 41 thereby directing the flow of water into the cylinder 26 so as to raise the seat 17. Again, it will be appreciated that by selective or controlled use of the inlet valve 40, the bather may control the rate at which he or she is raised from the bath tub 12 and the height of the seat 17 above the rim 15 of the bath tub 12.

It will be appreciated that the lift assembly described with reference to the drawings is portable and can be transposed from one bath tub to another and does not necessitate any alterations to existing bath tubs. Furthermore, there is no requirement for a separate power supply or additional mounting brackets etc. which are prone to corrosion or wear.

It will also be appreciated that the diameter of the ram may be varied and is dependent upon the pressure of the water supply which may vary from one locality to another. For example, in instances where the water pressure is low, a ram having a larger diameter will be required. Furthermore as the lift assembly is free standing it may be readily and easily mounted on existing bath tubs. When so mounted the lift assembly does not intrude into the bath tub and thus does not obstruct normal use or cleaning. In addition the drain valve constitutes the lowest part of the mounting assembly such that when the seat is lowered all actuating water is drained from the apparatus.

It will be realised that while the above has been given by way of illustrative example of this invention, all such and other modifications and variations thereto as would be apparent to persons skilled in the art are deemed to fall within the broad scope and ambit of this invention as is defined in the appended claims.

We claim:

1. A lift assembly for use on a bath tub or reservoir having an upper perimeter flange or rim, comprising:

support means for supporting a person to be raised and lowered;

mounting means for mounting said support means for movement between predetermined upper and lower positions and including a tubular frame member adapted for at least partial engagement with an upper perimeter flange or rim of a bath tub or reservoir, said mounting means including guide means upstanding from said tubular frame member, and carriage means reciprocatably mounted to said guide means; and a hydraulic ram assembly for raising and lowering said support means between said predetermined upper and lower positions, said hydraulic ram assembly including a cylinder assembly operatively connected to said support means for movement therewith and a piston assembly slidably engaged therein and operatively connected to said tubular frame member such that relative movement between said piston assembly and said tubular frame member is prevented, said tubular frame member being adapted to convey fluid to and from said cylinder assembly through a passage provided in said piston assembly to raise and lower said support means: said cylinder assembly and said support means being secured to said carriage means for reciprocating movement therewith.

2. A lift assembly as claimed in claim 1 including control means for controlling the flow of fluids to and from said hydraulic ram assembly, said control means including an elevating valve for controlling supply of fluid to said hydraulic ram assembly and a draining valve for draining fluid from said hydraulic ram assembly.

3. A lift assembly as claimed in claim 2, wherein said valves are adjacent positioned for operation by a person seated on said platform means.

4. A lift assembly as claimed in claim 2, wherein said draining valve permits substantially all actuating fluid to be drained from said lift assembly.

5. A lift assembly as claimed in claim 1, wherein said tubular, frame member is substantially U-shaped.

* * * * *